US008997731B2

(12) United States Patent
Leidig et al.

(10) Patent No.: US 8,997,731 B2
(45) Date of Patent: Apr. 7, 2015

(54) GAS COOKING APPLIANCE

(75) Inventors: Karl Leidig, Insingen (DE); Francesco Corleoni, Meldola (IT); Edi Fabbro, Bertiolo (IT); Giancarlo Arrigoni, Udine (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 827 days.

(21) Appl. No.: 12/598,263

(22) PCT Filed: Apr. 16, 2008

(86) PCT No.: PCT/EP2008/003010

§ 371 (c)(1),
(2), (4) Date: Oct. 30, 2009

(87) PCT Pub. No.: WO2008/135140

PCT Pub. Date: Nov. 13, 2008

(65) Prior Publication Data

US 2010/0132691 A1 Jun. 3, 2010

(30) Foreign Application Priority Data

May 7, 2007 (EP) ..... 07009136

(51) Int. Cl.

| | |
|---|---|
| ***F24C 3/00*** | (2006.01) |
| ***F24C 3/06*** | (2006.01) |
| ***F24C 3/10*** | (2006.01) |

(52) U.S. Cl.

CPC ..... *F24C 3/067* (2013.01); *F24C 3/103* (2013.01)

(58) Field of Classification Search

CPC ..... F24C 3/00; F24C 3/08; F24C 3/06; F24C 3/126; F24C 3/12; F24C 5/12; F24C 7/04; F24C 7/043; F24C 7/046; F24C 15/34; F23N 5/02; F23N 3/08; F23N 3/082; F23N 5/08

USPC ..... 126/39 BA, 41 R, 37 A; 431/80, 78, 18, 431/75

See application file for complete search history.

(56) References Cited

U.S. PATENT DOCUMENTS

| | | | | |
|---|---|---|---|---|
| 3,331,707 | A * | 7/1967 | Werth | 136/253 |
| 3,751,303 | A * | 8/1973 | Kittl | 136/253 |
| 4,189,294 | A * | 2/1980 | Rice et al. | 431/7 |
| 4,665,397 | A * | 5/1987 | Pinnow | 340/5.64 |

(Continued)

FOREIGN PATENT DOCUMENTS

| | | |
|---|---|---|
| FR | 2741139 | 5/1997 |
| GB | 2347362 | 9/2000 |

(Continued)

OTHER PUBLICATIONS

International Search Report for PCT/EP2008/003010, dated Mar. 16, 2009, 3 pages.

*Primary Examiner* — Avinash Savani
(74) *Attorney, Agent, or Firm* — Pearne & Gordon LLP

(57) ABSTRACT

The invention relates to a gas burner for a gas cooking appliance with at least one gas hob and/or one gas oven, wherein the gas burner (10) comprises a heat source (18) and an electric ignition system (24), and wherein an electric or electronic control circuit (38) is provided for controlling the electric ignition system (24). According to the invention the gas burner (10) includes a photovoltaic generator (20) for generating the electric power for the electric ignition system (24).

21 Claims, 2 Drawing Sheets

(56) References Cited

U.S. PATENT DOCUMENTS

Figure 1:
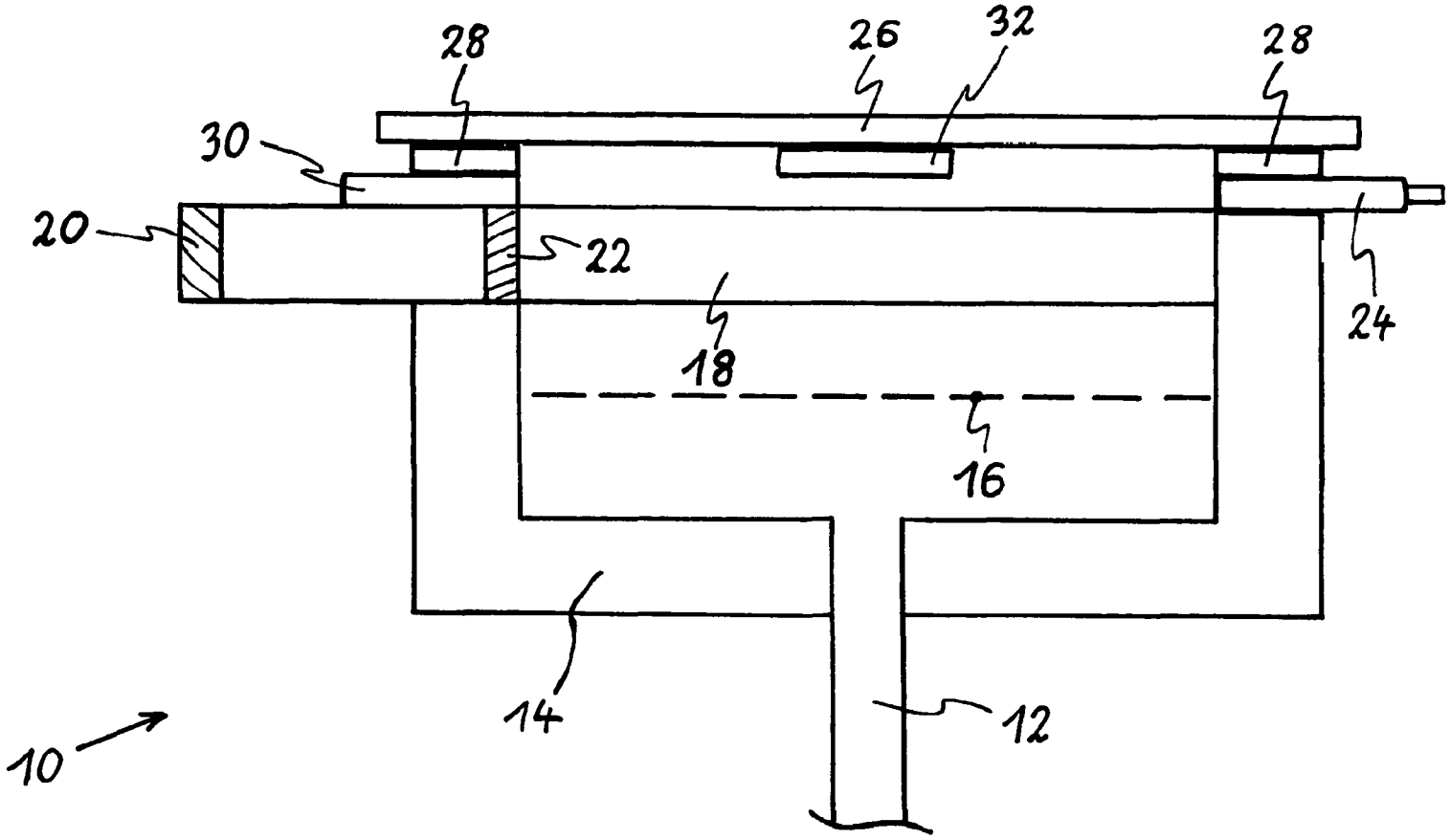

| | | | | | |
|---|---|---|---|---|---|
| 4,710,588 | A | * | 12/1987 | Ellion | 136/206 |
| 4,773,847 | A | * | 9/1988 | Shukla et al. | 431/46 |
| 4,906,178 | A | | 3/1990 | Goldstein et al. | |
| 5,387,399 | A | * | 2/1995 | Nishida et al. | 422/171 |
| 5,400,765 | A | * | 3/1995 | Goldstein et al. | 126/39 J |
| 5,642,004 | A | * | 6/1997 | Bircher | 307/66 |
| 5,659,133 | A | * | 8/1997 | Sims et al. | 73/114.09 |
| 5,720,608 | A | * | 2/1998 | Aoki et al. | 431/80 |
| 5,769,622 | A | * | 6/1998 | Aoki et al. | 431/80 |
| 5,968,456 | A | * | 10/1999 | Parise | 422/174 |
| 6,486,392 | B1 | * | 11/2002 | Samaras et al. | 136/253 |
| 2003/0223919 | A1 | * | 12/2003 | Kwak et al. | 422/174 |
| 2006/0016446 | A1 | | 1/2006 | Hu et al. | |

FOREIGN PATENT DOCUMENTS

| | | |
|---|---|---|
| WO | 0025068 | 5/2000 |
| WO | 2004042828 | 5/2004 |
| WO | 2006117484 | 11/2006 |

* cited by examiner

GAS COOKING APPLIANCE

The present invention relates to a gas cooking appliance having at least one gas burner.

Gas cooking appliances like ovens, hobs and barbecue grills have often an electric ignition system in order to spark the flame or ignite the gas combustion. However, the electric ignition system requires an electric power source.

Most of the gas cooking appliances with the electric ignition system use a power net cable and an electric power circuit with an AC/DC converter. This causes extra cost for the electric equipment.

For every region in the world there are different specific technical standards, in particular for the voltage or frequency. Thus, the gas cooking appliance cannot be used in every region of the world. If the electricity supply is interrupted, then the gas cooking appliance is not ready for use.

In some cooking appliances batteries are used to supply the electric ignition system. For example, 9V standard batteries may be used. These cooking appliances require no power net cable and not a corresponding electric power circuit. However, if no charges battery is available, then the gas cooking appliance is not ready for use.

It is an object of the invention to provide a gas cooking appliance, which overcomes at least some of the aforementioned difficulties.

This object is achieved by the gas cooking appliance according to claim 1.

According to the present invention the gas cooking appliance comprises a generator for generating electric power (electric energy, electric current, electric voltage) by conversion of radiation power and/or heat power emitted by the gas burner and/or by the sun or surroundings into electric power.

This electric power generated by the generator is in particular used for an electric ignition system of the gas burner(s) to ignite the gas combustion but can also be used for other electric consumers such as displays, electronic devices such as control devices etc. The generation of the electric power by the generator allows for having a power supply, which is independent of the power grid and other conventional power sources. Either the electric energy generated in previous gas cooking steps and stored in an electric storage device such as a capacitor and/or a rechargeable battery can be used for ignition of a new gas combustion and cooking process or the electric power generated by the generator from the surrounding radiation or heat of the sun, the atmosphere, artificial light and/or heat sources etc. or both.

The gas burner(s) typically comprises a heat source which generates the heat by gas combustion and an electric ignition system. Furthermore an electric or electronic control circuit is in general provided for controlling the electric ignition system.

According to a further aspect of the invention the generator converts the radiation from the heat source into electric power.

According to the preferred embodiment of the present invention the generator is or comprises a photovoltaic generator, in particular at least one solar cell. For a high efficiency the inter-band absorption energy of the material for the solar cell is adapted to the emitted radiation from the heat source. For example, the solar cell is made of a material including silicon and/or indium-antimonid.

In one embodiment of the present invention the heat source comprises an open flame. The open flame is a typical embodiment for conventional gas burners and gas hobs, which may be produced with low costs. The present invention may be advantageously used for the gas burners with an open flame.

In another embodiment of the present invention the heat source is arranged within a closed space of the gas burner. The present invention may be also applied to gas burners with to a closed space.

The heat source may comprise at least one catalytic material. For example, the heat source may comprise at least one monolith catalyst.

According to the preferred embodiment of the present invention a filter is arranged between the heat source and the (photovoltaic) generator. This allows a selection of the radiation from the heat source. Preferably, a heat radiation with a short wavelength should reach the (photovoltaic) generator.

Preferably, the filter comprises a band filter against a heat radiation with a long wavelength. This reduces heating up of the (photovoltaic) generator.

Further, the filter may comprise an infrared optical lens. This allows a concentration of the radiation and increases the efficiency. Additionally, said filter may be provided with a wave guide.

The gas burner may comprise a gas outlet, especially, if the flame is in a closed space.

To prevent that the (photovoltaic) generator will be heated, cooling means may be provided for the generator. For instance at least a part of the generator is arranged within an air stream and/or connected to a thermal conductor and/or to a heat pipe in order to cool the generator.

According to the preferred embodiment of the present invention at least one storage element for storing electric energy is provided. Preferably, the storage element is provided for storing the energy for the electric ignition system.

For example, the storage element may comprise at least one storage capacitor. Furthermore, the storage element may comprise at least one rechargeable battery. In both case the storage element may be loaded by the (photovoltaic) generator.

Further, at least one power supply device can be provided, which is connected or connectable to the power grid. Said power supply device guarantees, that the gas burner is also then useable, if the storage element is empty and in those cases where a power grid is available.

The power supply device may comprise at least one AC/DC converter. This allows a direct contact to the storage element. Preferably, the power supply is provided for loading the storage element.

The electric or electronic control circuit may be realized by hardware and/or software components. For example, the control circuit comprises at least one microprocessor.

Further the present invention relates to a gas cooking appliance having a gas cooking hob and/or a gas oven.

Novel and inventive features believed to the characteristic of the present invention are set forth inter alia in the appended claims.

Figure 2:
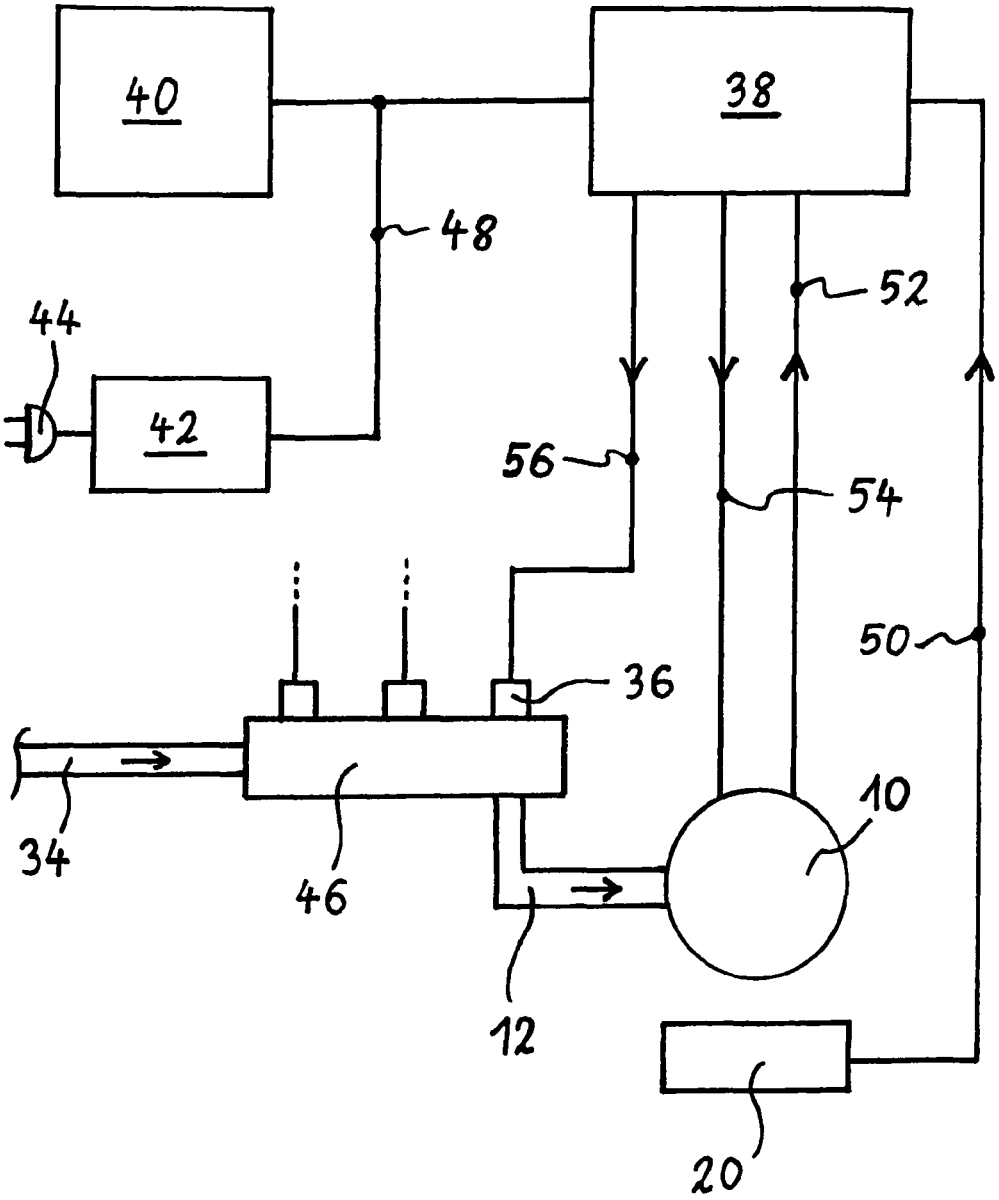

The invention will be described in further detail with reference to the drawing, in which FIG. 1 illustrates a schematic sectional front view of gas burner according to a preferred embodiment of the invention, and FIG. 2 illustrates a schematic block diagram of a part of a gas hob according to the preferred embodiment of the invention.

FIG. 1 illustrates a schematic sectional front view of a gas burner 10 according to a preferred embodiment of the invention. The gas burner 10 is a part of a gas hob.

The gas burner 10 comprises a gas supply line 12. The gas supply line 12 is provided for a mixture of gas and air. The bottom and the sidewalls of the gas burner 10 are formed by a thermal insulator 14. The gas supply line 12 penetrates into the bottom of the thermal insulator 14. Inside the thermal insulator 14 there is a gas divider 16. The gas divider 16 extends in a horizontal plane within the whole inner width of the thermal insulator 14. Above the gas divider 16 a monolith catalyst 18 is arranged. The monolith catalyst 18 extends also within the whole inner width of the thermal insulator 14.

The upper side of the gas burner 10 is formed by a ceramic glass 26. The thermal insulator 14 and the ceramic glass 26 form a closed space. Inside of said closed space the gas divider and the monolith catalyst 18 are arranged. A gas sealant 28 is arranged between the thermal insulator 14 and the ceramic glass 26. Under the ceramic glass 26 a gas outlet 32 is provided.

In the sidewall of the thermal insulator 14 is an electric ignition 24. The electric ignition 24 is provided to ignite the flame of the gas burner 10. A electric circuit is provided in order to supply the electric ignition 24 with electric voltage and to control the electric ignition 24. The electric ignition 24 requires a DC voltage.

Further a temperature sensor 30 is in the sidewall of the thermal insulator 14. The temperature sensor 30 is provided to detect the temperature inside the gas burner 10. The temperature sensor 30 may be connected to an electric circuit in order to control the gas burner 10.

On the outside of the thermal insulator 14 a photovoltaic generator 20 is arranged. The photovoltaic generator 20 is optically connected to the monolith catalyst 18. Therefore the photovoltaic generator 20 receives the radiation from the monolith catalyst 18.

The photovoltaic generator 20 may be realized by one or more conventional photovoltaic cells. For example, the photovoltaic cell is made of a material including silicon and/or indium-antimonid. The photovoltaic generator 20 transforms the energy of the radiation into electric energy. Preferably, the inter-band absorption energy of the material of the solar cell is adapted to the emitted radiation from the heat source. This allows the most efficiency of the solar cell.

Between the monolith catalyst 18 and the photovoltaic generator 20 a filter 22 is arranged. The filter 22 avoids that heat radiation with a long wavelength attains to the photovoltaic generator 20. This prevents, that the photovoltaic generator 20 will be heated up. The photovoltaic generator 20 works efficiently at a low temperature.

Further, cooling means are provided in order to hold the photovoltaic generator 20 at a low temperature. Said cooling means are not shown in FIG. 1. The cooling means may be realized by an air stream, a thermal conductor and/or a heat pipe, for example.

The gas burner 10 described above is a catalytic gas burner under glass. According to an alternative embodiment of the present invention the gas burner 10 may be provided with an open flame. In this case the photovoltaic generator 20 receives the radiation from said flame.

FIG. 2 illustrates a schematic block diagram of a gas hob with the gas burner 10 according to the present invention. The gas hob includes the gas burner 10 and the photovoltaic generator 20. Further the gas hob includes a central gas line 34, an electronic control circuit 38, a storage capacitor 40, an AC/DC power supply unit 42, a valve arrangement 46 and the gas supply line 12.

The valve arrangement 46 is interconnected between the central gas line 34 and the gas supply line 12. The valve arrangement 46 comprises a valve 36 and some further valves. The valve 36 corresponds with the gas burner 10 and is provided to adjust the flow of the gas-air-mixture to the gas burner 10. The electronic control circuit 38 is electrically connected to the valve 36 via a control line 56. The valve 36 may be adjusted manually by the user and/or automatically by the electronic control circuit 38 via the control line 56.

The electronic control circuit 38 is connected to the storage capacitor 40 and to the AC/DC power supply unit 42 via a first DC line 48. The first DC line 48 connects further the storage capacitor 40 and the AC/DC power supply unit 42. The AC/DC power supply unit 42 comprises a plug 44 in order to connect the AC/DC power supply unit 42 to the power grid. The AC/DC power supply unit 42 supplies the storage capacitor 40 with electric energy. If the AC/DC power supply unit 42 is connected to the power grid, then an external back up of the storage capacitor 40 may be performed.

The photovoltaic generator 20 is electrically connected to the electronic control circuit 38 via a second DC line 50. The electric energy generated by the photovoltaic generator 20 is transmitted to the electronic control circuit 38 and after that stored in the storage capacitor 40.

The storage capacitor 40 supplies the electronic control circuit 38 and the electric ignition 24 with the initial power in order to start the gas burner 10. Then the storage capacitor 40 is recharged by the photovoltaic generator 20 while the gas burner 10 is in use.

Instead of the storage capacitor 40 alternatively a rechargeable battery may be used. Such a rechargeable battery is able to keep the load for several starting cycles after a certain defined idle phase.

The electronic control circuit 38 is connected to the ignition 24 of the gas burner 10 via an ignition line 54. The ignition 24 is provided with the ignition voltage by the electronic control circuit 38.

Further, the electronic control circuit 38 is connected to the thermo sensor 30 of the gas burner 10 via a detection line 52. The thermo sensor 30 detects the temperature in the gas burner 10 and transmits the temperature value as an electric signal to the electronic control circuit 38.

The present invention offers all the advantages of the electronic control to gas appliances and additionally allows the independency from the power grid.

A gas cooking appliance with the gas burner 10 according to the present invention is locally independent and allows an outdoor use.

Further the gas burner 10 according to the present invention allows the usability of a gas cooking appliance inside a kitchen, when electricity is broken down like in a black out.

Additionally the gas cooking appliance with the gas burner 10 according to the present invention may be created in one single design for all countries in world, since said gas cooking appliance is independent of the power grids with their specific voltages and frequencies.

LIST OF REFERENCE NUMERALS

10 gas burner
12 gas supply line
14 thermal insulator
16 gas divider
18 monolith catalyst
20 photovoltaic generator
22 filter
24 electric ignition
26 ceramic glass
28 gas sealant
30 temperature sensor
32 gas outlet
34 central gas line
36 valve
38 electronic control circuit

40 storage capacitor
42 AC/DC power supply unit
44 plug
46 valve arrangement
48 first DC line
50 second DC line
52 detection line
54 ignition line
56 control line

The invention claimed is:

1. A gas cooking appliance, having at least one gas burner provided on a gas cooking hob and/or a gas oven including a surface on which cookware to be exposed to heat from the gas burner is to be supported, the gas burner comprising a gas divider to establish a desired distribution of a combustible gas across the gas burner, an annular thermal insulator defining an inner width, a ceramic portion enclosing at least a portion of the inner width, a monolith catalyst disposed within the inner width between the gas divider and the ceramic portion, the monolith catalyst extending across an entire extent of the inner width, and at least one generator for generating electric power by conversion of radiation power, wherein the gas burner further comprises an electric ignition system for ignition of gas combustion, and wherein the generator provides electric power for the electric ignition system, and wherein the generator is exposed to electromagnetic radiation from a combustion zone of the gas burner at a location recessed in the gas cooking appliance relative to the surface on which the cookware is to be supported and converts said electromagnetic radiation into electric power.

2. The gas cooking appliance according to claim 1, comprising at least one electric consumer unit, wherein the generator provides electric power for the electric consumer unit.

3. The gas cooking appliance according to claim 1 wherein an electric or electronic control circuit is provided for controlling the electric ignition system.

4. The gas cooking appliance according to claim 1, wherein the generator is or comprises a photovoltaic generator, in particular at least one solar cell.

5. The gas cooking appliance according to claim 4, wherein an inter-band absorption energy of a material of the photovoltaic generator is adapted to receive an emitted radiation from the gas burner.

6. The gas cooking appliance according to claim 4, wherein the solar cell is made of a material including silicon and/or indium-antimonid.

7. The gas cooking appliance according to claim 1, wherein the monolith catalyst is arranged within a closed space of the gas burner.

8. The gas cooking appliance according to claim 1, wherein the at least one gas burner comprises a gas or fluid outlet.

9. The gas cooking appliance according to claim 1, wherein cooling means are provided for the generator.

10. The gas cooking appliance according to claim 9, wherein at least a part of the generator is arranged within an air stream in order to cool the generator.

11. The gas cooking appliance according to claim 1, wherein at least one storage element for storing electric energy is provided.

12. The gas cooking appliance according to claim 11, wherein the storage element comprises at least one storage capacitor.

13. The gas cooking appliance according claim 11, wherein the storage element comprises at least one rechargeable battery.

14. The gas cooking appliance according to claim 11, wherein the storage element (40) is given power from the generator.

15. The gas cooking appliance according to claim 1, wherein at least one power supply unit is provided, which is connected or connectable to a power grid or net.

16. The gas cooking appliance according to claim 15, wherein the power supply unit comprises at least one AC/DC converter.

17. The gas cooking appliance according to claim 15 wherein the power supply unit gives power to the storage element.

18. A gas cooking appliance comprising:

a gas burner arranged to generate heat for emitting heat from a gas hob;

a surface for supporting cookware vertically above the gas burner;

an electric ignition system for ignition of gas combustion by said gas burner;

a catalyst;

a generator recessed in said gas cooking appliance relative to the surface and optically connected to the catalyst to be exposed to a portion of radiation energy from the gas burner via the catalyst and convert the portion of the radiation energy into electric power; and a filter between the catalyst and the generator, wherein the filter exhibits a transmission preference favoring transmission of the radiation energy comprising a relatively-short wavelength from gas combusted at the catalyst over transmission of the radiation energy comprising a relatively-long wavelength from the gas combusted at the catalyst.

19. The gas cooking appliance according to claim 18, wherein the filter comprises a band filter against infrared radiation.

20. The gas cooking appliance according to claim 19, wherein the filter comprises an infrared optical lens.

21. The gas cooking appliance according to claim 19, wherein the filter is provided with a wave guide.

* * * * *